US006070381A

United States Patent [19]

Blumer

[11] Patent Number: 6,070,381

[45] Date of Patent: Jun. 6, 2000

[54] ELASTIC FLOOR

[75] Inventor: Samuel Blumer, Betschwanden, Switzerland

[73] Assignee: SW Stanzwerk Glarus AG, Switzerland

[21] Appl. No.: 08/948,257

[22] Filed: Oct. 9, 1997

[30] Foreign Application Priority Data

Oct. 10, 1996 [DE] Germany ..... 196 41 812

[51] Int. Cl.[7] ..... E04F 15/22

[52] U.S. Cl. ..... 52/403.1; 52/126.6; 52/126.7; 52/127.2; 52/506.06; 156/71; 248/634; 267/122

[58] Field of Search ..... 52/126.1, 126.5, 52/126.6, 126.7, 127.2, 167.7, 167.9, 403.1, 480, 742.15, 745.05, 746.1, 747.11, 263, 506.01, 506.06, 508, 742.13, 747.1; 248/633, 634; 267/118, 122, 140.11; 156/71

[56] References Cited

U.S. PATENT DOCUMENTS

| | | | |
|---|---|---|---|
| 2,116,654 | 5/1938 | Barge | 52/480 X |
| 2,263,599 | 11/1941 | Tucker . | |
| 2,597,800 | 5/1952 | Hussman | 52/167.7 X |
| 4,077,346 | 3/1978 | Inoue et al. | 52/126.7 X |
| 4,570,397 | 2/1986 | Creske | 52/126.6 |
| 4,581,863 | 4/1986 | Thaler | 52/126.6 X |
| 4,856,626 | 8/1989 | Nakanishi | 267/122 X |
| 4,942,703 | 7/1990 | Nicolai | 248/634 X |
| 5,234,203 | 8/1993 | Smith | 267/122 X |

OTHER PUBLICATIONS

Takao, "Vibration Control Device", Patent Abstracts of Japan, Publication No. 07197967 A, Jan. 8, 1995, Bridgestone Corp.

*Primary Examiner*—Carl D. Friedman
*Assistant Examiner*—Kevin D. Wilkens
*Attorney, Agent, or Firm*—Larson & Taylor

[57] ABSTRACT

A method for constructing a resilient floor on a solid base utilizes plate-shaped elements. Hollow, height-adjustable elements are fastened on the base and are filled with an elastically hardening material, which is adhesive in the flowable state. Prior to hardening, base plates are placed on the filled elements and are aligned. When lifted, the base plates move the elements located below them because of the adhesion of the filler material to the base plates. After hardening, at least one further floor layer is placed on the base plates. This method can be executed rapidly.

5 Claims, 4 Drawing Sheets

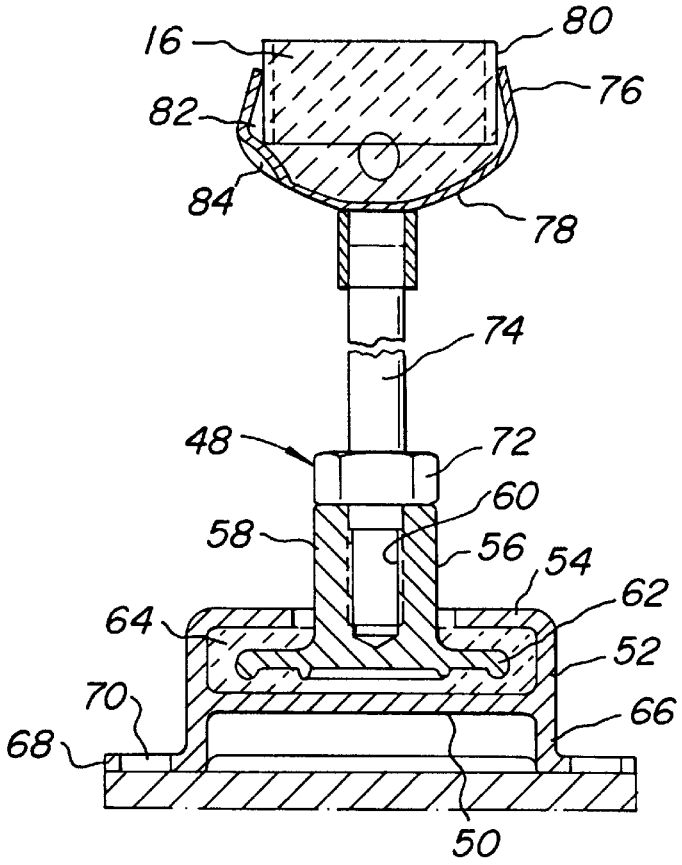
Fig. 2
Fig. 3
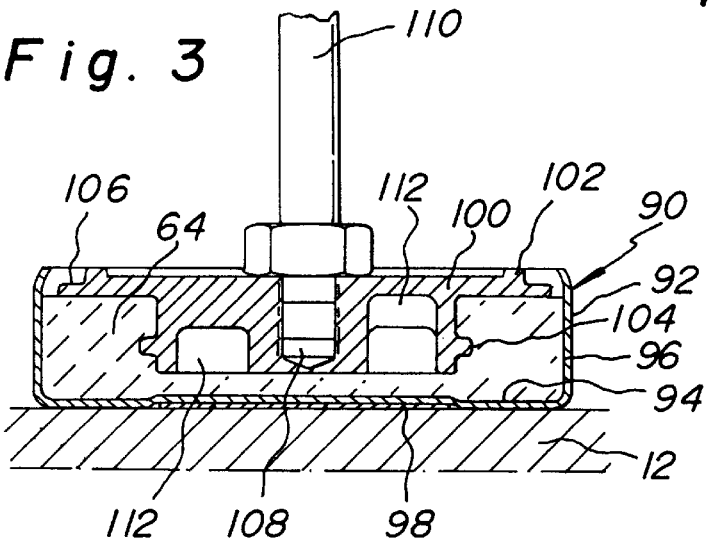
Fig. 4
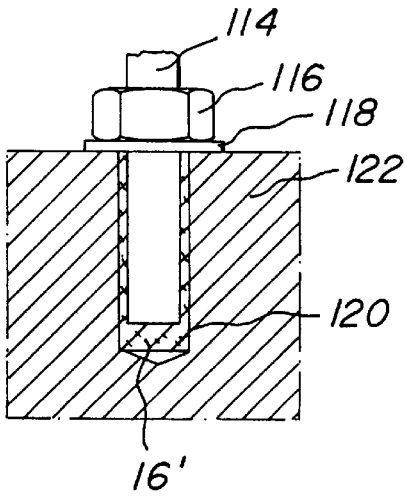

ELASTIC FLOOR

FIELD OF THE INVENTION

The invention relates to a method for constructing a resilient floor on a solid base, for example a concrete or stone or clay floor, using plate-shaped elements.

BACKGROUND OF THE INVENTION

Resilient floors, such as are used in sports arenas, are expensive to install because of their complicated structure. In these cases the actual floor is mounted on a resilient base. Difficulties mainly arise in the course of installation for obtaining the same vibration and damping properties over the entire area of the room, as well as a level surface of the floor, which is problematical, in particular when using floor tiles of comparatively small format.

OBJECT AND SUMMARY OF THE INVENTION

It is the object of the invention to provide a method for producing a resilient floor which can be executed simpler and with less outlay of materials, and yet results in a floor with good vibration and damping properties.

This object is attained in accordance with the invention by means of a method wherein first hollow supports, which are open at the top and are height-adjustable, are fastened on the base, the supports are filled in sections with a material which is hardenable into an elastic state and is adhesive in the flowable state, base plates are placed on the filled support prior to hardening and are aligned horizontally as well as with each other, wherein during alignment the base plates take along a portion of the supports located under them because of the adhesion of the still not yet hardened filler material and change their height, and after hardening at least one other floor layer is applied to the base plates.

The method can be executed rapidly and by simple means, since the elastic supports do not form a connected structure and instead are individually fastened on the base. Alignment of the plate elements is performed with generally known means, for example a mason's level, and can be performed without a large effort of strength because of the low weight of a single plate element and the not yet hardened filler material.

In order to be able in connection with the above described method to adjust the base plates in height and to align them on the supports, which cannot yet be subjected to a load and are filled with the liquid base material of elastomers, they are preferably temporarily supported on the base by means of threaded spindles or wire spirals, which are in threaded contact with the base plates. The threaded spindles or wire spirals are removed after the filler material has hardened. Thereafter the base plates rest exclusively on the elastomeric damping bodies. In the next work step it is thereafter possible for producing the second floor layer to lay down plate elements with joints which are offset in respect to the joints between the base plates and to screw them together with the base plates.

To improve the damping effect it is possible to fill holes in the base with liquid elastomeric material and, for fastening the supports, to insert threaded rods, which constitute a part of the supports, into the holes before hardening. The respective insertion depth can then be determined by means of a nut. Additional damping elements, also prefabricated ones, can be connected in series with the first damping element, which is adjustable in its longitudinal direction.

Bellows, which are respectively fastened via a metal cap screwed to the base for protecting the material, are usefully employed as supports. Rubber, for example, is suitable as the material for the bellows which, because of its elastic properties, aids the adhesion of the sticky material during lifting of the base plates and, because of its resilience, makes cross-sectional changes of the bellows because of their constant fill volume during height changes possible. In place of the bellows, other supports, which can be adjusted in length, can also be used, for example two sleeves which are axially guided within each other, wherein however a volume equalization is practical, which is advantageous because of the volume changing with the height of such supports.

The volume equalization preferably takes place through a hollow chamber, into which the elastomeric material can flow in the course of pushing the sleeve elements together. Depending on whether the two sleeve elements are pulled apart or pushed together, the hollow chamber volume is increased or respectively decreased. In connection with a simpler alternative it is provided that at least one sleeve element has holes through which the liquid elastomeric material can be displaced. Since the supports are located in the non-visible area underneath the floor anyway, it is not disturbing if elastomeric material flows out of the holes or over the edges when the base plates are lowered. When the base plates are raised, air is aspirated through the holes, so that the adhesive elastomeric material remains stuck to the base plate and is not torn off because of an otherwise vacuum being created.

To achieve a better contact between the upper sleeve element and the base plate, the former preferably is made of an elastic material, for example rubber.

To improve the damping effect, it can be useful to connect the lower sleeve element in series with a further elastic damping element, which can be fastened to the base. In the simplest case the additional damping element consists of an elastomeric sheath of the fastening element of the support anchored in the base. But the two sleeve elements filled with liquid elastomer can also be connected in series with a prefabricated rubber/metal damping element.

The lower sleeve element is preferably connected with the further damping element by means of a threaded connection which is length-adjustable. For one, this allows a rough pre-adjustment of the height of the support, and it is also possible to make a height correction after the elastomeric material in the sleeves has hardened.

Some exemplary embodiments of the invention will be explained in detail below by means of the drawings.

BRIEF DESCRIPTION OF THE DRAWINGS

FIG. 2 is a perpendicular cross section through a sound-absorbing support with two elastomeric damping bodies arranged in a row, FIG. 3 is a cross section through a further embodiment, and FIG. 4 is a cross section through a sound-absorbing fastening on the base for a sound-absorbing support.

DETAILED DESCRIPTION OF THE PREFERRED EMBODIMENTS

Figure 1A:
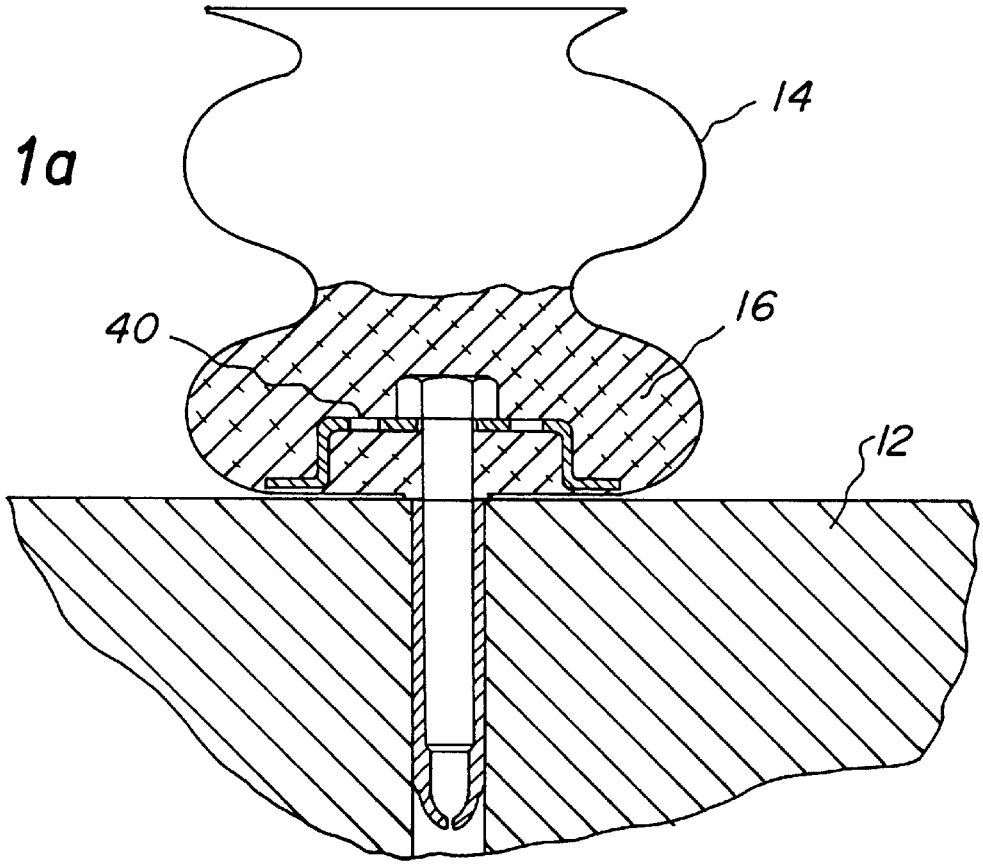
FIG. 1*a*–1*c* show perpendicular partial sectional views through a resilient floor seated on sound-absorbing supports during the various steps in the method of the invention; and, FIG. 1*d* shows a partial sectional view of an alternative embodiment for the threaded spindle shown in FIGS. 1*b*–*c,*
Figure 1B:
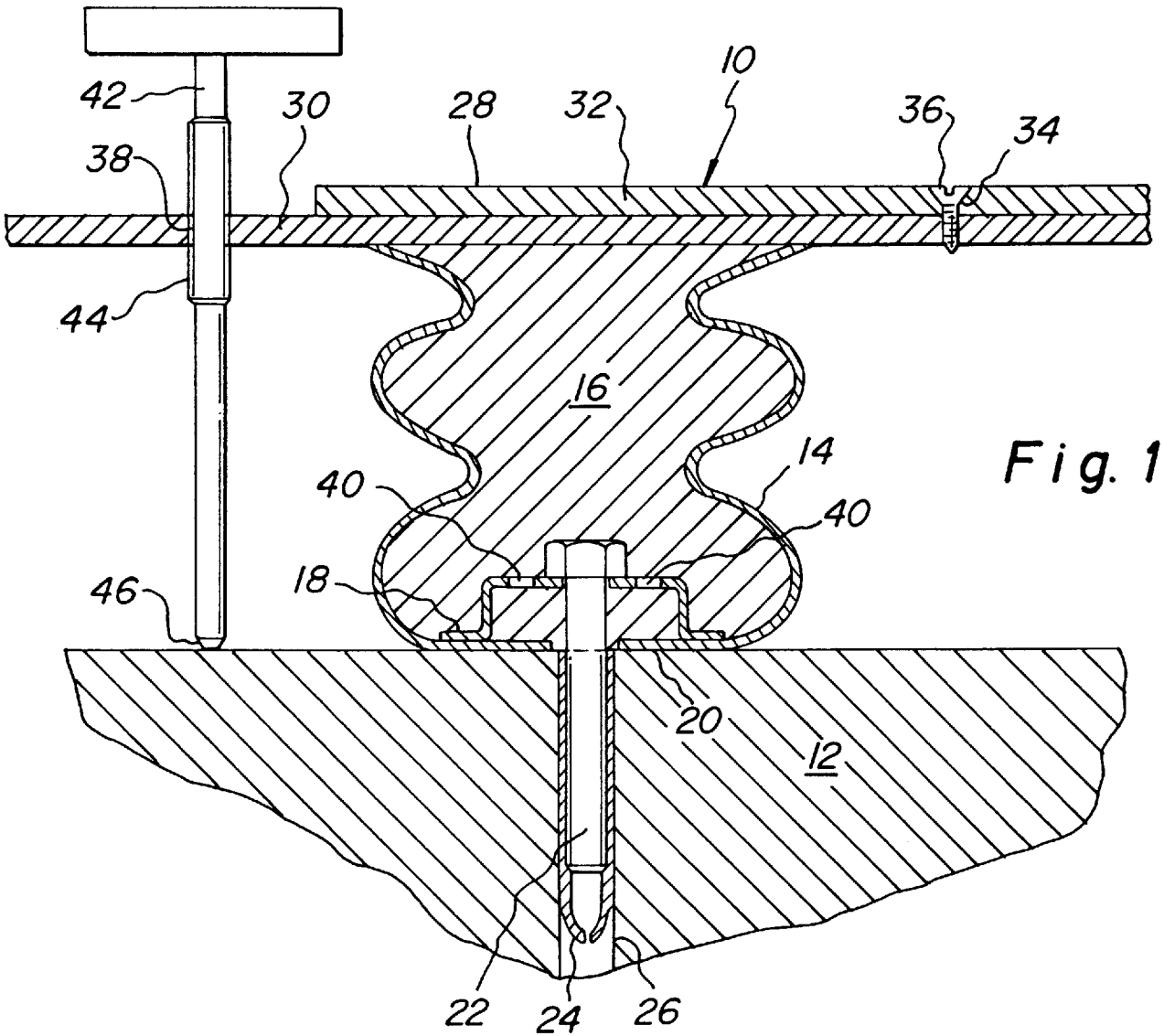
Figures 1C, 1D:
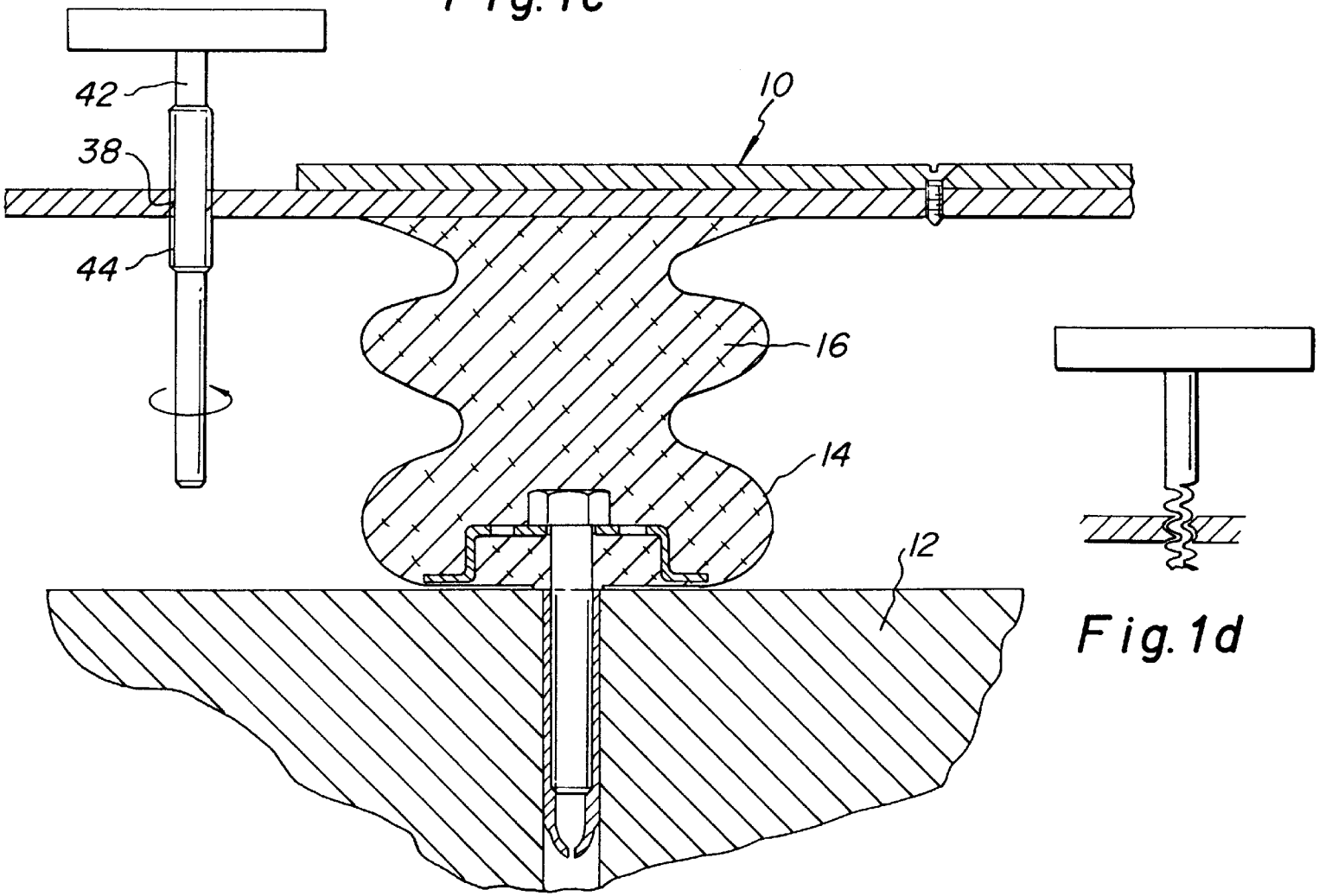

FIGS. 1*a*–*c* show the various steps in the manufacture of a resilient floor 10, which has been built on a solid base 12, for example of concrete or a stone or clay layer. Bellows 14 of rubber or another elastic material are fastened on the solid base and are filled with a hardened elastomer 16. The latter constitutes a damping body, the bellows 14 an envelope wall. To prevent damage to the rubber bellows 14 during its fastening on the base 12, the bellows 14 is screwed together with the base by means of a metal cap 18, wherein the seating element constituted by the metal cap 18 clamps the lower edge 20 of the bellows 14, which is essentially dynamically balanced. The screw 22 is seated in a dowel 24 in a hole 26 in the base 12, which assures a permanently secure fastening.

The actual floor 28, consisting of several base plates 30 and a floor covering 32 screwed thereon, which is also plate-shaped, rests on a plurality of such bellows 14. The covering plates 32 have a series of recesses 34, which receive the heads of countersunk screws 36. These are screwed into the base plates 30, which can consist of metal, wood or plastic.

In place of a plate-shaped floor covering 32, any other arbitrary floor coverings are also conceivable, in particular webs of plastic, which are glued to the base plates 30. If desired, carpeting can be placed on the floor covering 32, or some other seal can be applied.

The construction of such a resilient floor is made in the manner described below:

First, the holes 26 are drilled into the solid base 12 at defined distances and provided with the dowels 24. Thereafter, the bellows 24 are tightened on the metal caps 18 by means the screws 22. To make assembly at the site easier, the metal caps 18 can already be provisionally fastened on the lower edge 20 of the bellows 24, so that threading the metal cap 18 into the bellows 14 can be omitted.

Thereafter, as shown in FIG. 1*a*, the bellows 14 are filled with an elastomer 16 which has adhesive properties in its liquid state. In order to be able to also fill the hollow space under the metal cap 18, a number of holes 40 are provided therein. But the metal cap 18 can also be designed with depressions, for example, in such a way that during pouring a hollow space enclosed by the elastomeric material remains free, into which the latter is displaced when a load is applied. After filling the bellows 14 with the still liquid elastomer 16, which preferably takes place in steps only for the area of one base plate 30, the corresponding base plate 30 is placed as the upper seating element on the bellows 14 intended for it and is aligned.

As shown in FIG. 1*b*, alignment takes place with the aid of threaded spindles 42, which engage a screw thread 38. With metallic base plates 30, the screw thread can be cut directly into the plate, while with softer materials, for example wood or plastic, it might be necessary to have to insert a threaded bushing in the plate. But in connection with soft materials it is often sufficient to simply guide the spindle through a narrow bore, since only a slight force is required for lifting the plates. In the extension of their threaded section 44, the threaded spindles 42 have a pressure section 46, whose diameter is less than the interior diameter of the screw thread 44. Because of this the threaded spindle 42 can be easily and rapidly inserted into the screw thread 38 and need not be turned in over the entire distance from the base to the base plate. As soon as the pressure section 46 contacts the base 12, it is possible to lift the corresponding base plate by further turning the threaded spindle 42 in a clockwise direction. In order to make an optimal alignment possible, the base plate 30 should have at least three screw threads 38 at opposite ends.

Since no great force is required for lifting the plates, it is also possible to employ solid wire spirals, similar to a corkscrew, as shown in FIG. 1*d*, which are threaded into the plates through holes, in place of the relatively elaborate threaded spindles and the required screw threads.

The taking along of the bellows 14 during the lifting of the base plates 30 is provided on the one hand by the inherent elasticity of the rubber material of the bellows 14 and, on the other hand, by the adhesion between the elastomer 16 and the underside of the base plates 30. As soon as the latter have been aligned in the desired position, the threaded spindles 42 are left in their instantaneous position in order to prevent the displacement of the base plate 30 because of its inherent weight or because of accidental pushing. The same procedure is followed in connection with the remaining base plates 30 of the floor 28. In the process, use is made of the fact that the elastomer has adhesive properties in the liquid state and makes a transition into an elastic state following hardening and vulcanization, depending on whether it is a two-component or one-component material. Following hardening, the threaded spindles 42 can be removed as shown in FIG. 1*c*. The base plates 30, together with the bellows arranged respectively under them and the hardened elastomer, constitute a resilient system. To complete the floor 28, the further floor covering plates 32 are screwed to the base plates 30 after hardening. The recesses 34 permit the heads of the countersunk screws 36 to end flush with the surface of the covering plates 32. Care should be taken that the joints of the two plate layers 30, 32 are offset in respect to each other in order to obtain improved stiffening and to prevent continuous gaps.

Because of the inherent damping of the elastomer 16, the resilient floor 10 has good damping properties which are much desired, for example in sports arenas, since they reduce stress on the joints and the muscles.

The exemplary embodiment illustrated in FIG. 2 shows a support 48 with a further damping element arranged in series. The lower damping element identified by 50 forms a sort of can with its envelope wall 52, whose upper edge forms a flange 54 extending radially far into the interior. The latter is provided with four radially extending finger-like recesses, which are arranged in the shape of a cross. The upper seating element identified by 56 has a central hub 58 with a concentric, open at the top, threaded blind bore 60, as well as four fingers 62 at the base, arranged in the form of a cross, which are slightly smaller than the finger-shaped recesses in the flange 54. For this reason it is possible, in spite of the central opening in the flange 54 which is only slightly larger in size than the hub 58, to introduce the upper seating element 56 with its finger-shaped base from above in relation to FIG. 2 into the interior space bordered by the envelope wall 52 and the flange 54, which was filled with the initially liquid mass of elastomeric material 64. Following the axial introduction of the fingers 62 of the base through the finger-shaped recesses in the flange 54, the upper seating element 56 is turned by 45° around a perpendicular center longitudinal axis, so that a position results, in which the massive areas of the flange 54 extend over the fingers 62. In this position the upper seating element 56 is held away from the can-shaped damping element at a distance on all sides, until the elastomeric material 64 has been hardened into a rubber-elastic damping body. The lower damping element 50 has a collar 66 in the extension of its envelope wall with radial feet 68 which, with through-bores 70, are intended to screwing the support in place on a level floor.

The hub-shaped element 58 of the upper seating element 56 has a long threaded bore 60, which offers an extensive adjustment possibility for the height of the support. A threaded rod 74, screwed more or less deeply into the threaded bore 60 and maintained in the selected position by a counter nut 72, supports on its upper end a lower sleeve element 78, made of one piece with a wall 76, via a threaded connection. A cylindrical box 80, made of an elastomeric material, has been inserted as the upper sleeve element into the sleeve element 76, 78, shaped as a whole like a can or a dish. With its outer circumference it rests against the upper edge of the wall 76, which is slightly bent inward. Thanks to the elastic properties of the box 80, the pressure at the contact point can be so great that it is frictionally maintained in any desired position in relation to the wall 76. It is therefore possible in principle, in addition to the adjustment possibilities via the screw threads at both ends of the threaded rod 74, to adjust the height of the support by pulling the box 80 further out of the sleeve element 76, 78. Following the selection of the axial adjustment of the box 80 in relation to the upper edge of the wall 76, a liquid elastomeric material is poured into the box 80 up to its upper rim edge. The liquid mass also fills the can-shaped sleeve element 76, 78 and is hardened into a damping body, i.e., elastomer 16, of a height selected by the axial positioning of the box 80. A hollow space 82, which is not filled by the elastomer 16, remains below the radially pulled-in upper edge of the wall 76 between the latter and the box 80. In this way it is possible, as in the embodiment of FIG. 1, to connect a base plate, not shown, with the elastomer 16, or damping body, by contact with the liquid elastomeric material.

If its has been decided from the start that the box 80 is to have a defined axial position in relation to the wall 76, it can also be formed with, for example, three squeezed-in spots 84, which are distributed over the circumference at the same level and form a detent and a support for the box 80 inserted from above into the opening of the sleeve elements 76, 78.

A further exemplary embodiment of a lower damping element 90 is represented in FIG. 3. It has a very simple structure and a very low structural height. In its exterior shape it is like a round can, whose lower element 92 has a bottom 94 and a cylindrical envelope wall 96 connected in one piece with it. In order to achieve a slip-proof adhesion of the bottom 94 used as the lower seating element on the base 12, a flat rubber pad 98 has been glued into a flat recess in the bottom, which slightly projects past the underside of the bottom 94. The can-shaped lower element 92 is filled with an elastomeric material 64, which is poured in its flowable state prior to hardening. An upper seating element 100 has been inserted into the still liquid mass far enough, so that it takes up a position as if it were floating on the mass. The upper seating element 100 was held in this position by a device supporting it until the elastomeric material had hardened.

In order to achieve the possibly largest support force in respect to the diameter of the support, the upper seating element 100 covers essentially the entire surface of the elastomeric material 64 or respectively the entire opening of the lower element 92. Only a sufficiently broad annular gap remains between the envelope wall 96 and the upper seating element 100, in order to allow the oscillating movements of the upper seating element 100 occurring during use in relation to the lower element 92.

In the exemplary embodiment, the upper seating element 100 is provided in the area of its circumference with an upward projecting annular rib 102, which borders an upper placement surface, on which the foot of an object to be seated, for example, will find room. The upper edge of the annular rib 102 is at the level of the upper rim edge of the lower element 92, which is slightly radially retracted in order to prevent the damping body constituted by the elastomeric material 64 from being pulled out together with the upper seating element 100 in case of an unanticipated tension load. The damping body can also extend as far as the upper edge of the lower element 92 or can terminate slightly below it. The anchoring of the upper seating element 100 in the damping body 64 is assured by one or several radially outwardly projecting annular ribs 104, 106.

In the center, the upper seating element 100 is provided with a threaded blind bore 108, open at the top. A threaded rod 110 is screwed into it in order to hold the upper seating element 100 during the hardening of the elastomeric material 64. In later use the lower sleeve element 78 is screwed on the threaded rod 110 (see FIG. 2).

The characteristic feature of the support in accordance with FIG. 3 resides in three depressions 112 distributed over the circumference and annularly connected, in which air cushions are placed to prevent them from being completely filled with elastomeric material 64 during the manufacturing process. Therefore hollow spaces remain in the depressions 112 underneath the surface of the upper seating element 100 under load, into which the rubber-elastic material of the damping body 64 can enter to a greater or lesser extent if it is compressed in height and cannot escape radially to the outside because of the rigid envelope wall 96. The displacement option offered by the hollow spaces 112 therefore also leads to a softer elastic characteristic and improved sound absorption than with a corresponding support without such hollow spaces 112.

It is understood that it is not required for the advantageous effects of the hollow spaces whether these are in depressions of the upper sealing element 100. Such hollow spaces can also be present in depressions of the lower sealing element 94 or the envelope wall 96 which, for example, are covered by a foil during the pouring of the liquid mass of the elastomeric material 64 in order to enclose the air cushion. It is also possible by known means to generate hollow spaces in the center of the elastomeric mass, either by entrapping air bubbles or by propellants.

The supporting force and arrangement of the hollow spaces 112 can be affected by the shape, size and arrangement of the hollow spaces 112, without it being necessary to change the composition of the elastomeric material 64. It is therefore possible, for example by means of comparatively shallow depressions 112, to intentionally achieve a comparatively soft seating during low loads, but a harder, less resilient seating with heavy loads.

A damping threaded rod 114, fastened directly in the base 12, with an adjusting nut 116 screwed on it and with a washer 118 of metal or of an elastomeric material is represented in FIG. 4. The represented arrangement is extraordinarily simple. The lower end of the threaded rod 114 is inserted into a bore 120 in a concrete cover 122 or in the stone or clay floor. The diameter of the bore 120 is slightly larger than the exterior diameter of the threaded rod 114. Prior to inserting the latter, a liquid adhesive or liquid elastomeric material 16' has been poured into the bore 120, which also acts in a sound-absorbent manner and as a series-connected damping element.

Even if it is noticed after the hardening of the adhesive or the rubber-elastic material in the bore 120 that it is necessary to readjust the support in height, this causes no difficulties, because this adjustment can be performed by rotating the lower sleeve element 78 screwed on the threaded rod 114.

It is understood the numerous further variations of the individual parts of the supports represented in the drawings are possible while maintaining the basic principle of the use of a damping body which is enclosed to a considerable part but remains free to be deformed.

What is claimed is:

1. A method of making a resilient floor comprising base plates on a solid base, the method comprising:

fastening height-adjustable supports having open tops on said base;

filling said supports with an elastomeric material to form filled supports in an area wherein a respective one of said base plates is to be positioned, said elastomeric material being adhesive in a flowable state;

placing said respective base plate on said filled supports prior to hardening of said elastomeric material;

aligning said respective base plate on the filled supports prior to hardening of said elastomeric material;

repeating said steps of filling, placing and aligning for additional respective base plates until a desired number of base plates are positioned on said supports;

aligning each of said base plates horizontally and with respect to each other prior to hardening of said elastomeric material, a portion of the supports located under said base plates being movable with said base plates during alignment as a result of adhesion of said elastomeric material to a surface of said base plates or a surface engaging said base plates such that height of said supports is adjusted; and applying at least one floor layer to said base plates after hardening of said elastomeric material.

2. The method according to claim 1 wherein, during said steps of aligning, the base plates are temporarily supported on the base by threaded spindles or wire spirals in a threaded connection with the base plates.

3. The method according to claim 2, further comprising the step of removing the threaded spindles or wire spirals after hardening of the elastomeric material.

4. The method according to claim applying comprises screwing plate elements to the base plates in a position offset in relation to the base plates.

5. The method according to claim 1, further comprising filling holes in the base with a liquid elastomeric material during said step of filling the supports, and inserting threaded rods constituting a portion of the supports into the holes for fastening the supports.

* * * * *